US007459650B2

(12) United States Patent
Weister et al.

(10) Patent No.: US 7,459,650 B2
(45) Date of Patent: Dec. 2, 2008

(54) ELECTRICAL SWITCHING APPARATUS, AND LATCH ASSEMBLY AND LATCH ENGAGEMENT CONTROL MECHANISM THEREFOR

(75) Inventors: Nathan J. Weister, Darlington, PA (US); Paul R. Rakus, Beaver Falls, PA (US); Douglas C. Marks, Murrysville, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/737,219

(22) Filed: Apr. 19, 2007

(65) Prior Publication Data

US 2008/0257702 A1 Oct. 23, 2008

(51) Int. Cl.
*H01H 5/00* (2006.01)

(52) U.S. Cl. ..... 200/400

(58) Field of Classification Search ..... 200/400, 200/401, 244, 239, 250; 335/16, 188, 191, 335/36–37; 74/97.1

See application file for complete search history.

(56) References Cited

U.S. PATENT DOCUMENTS

| | | | | |
|---|---|---|---|---|
| 3,002,068 | A * | 9/1961 | Maier | 200/401 |
| 6,066,821 | A | 5/2000 | Wehrli, III et al. | 200/552 |
| 6,437,269 | B1 | 8/2002 | Rakus | 200/400 |
| 6,870,112 | B2 * | 3/2005 | Bresciani et al. | 200/400 |
| 7,115,830 | B1 | 10/2006 | Weister et al. | 200/400 |

* cited by examiner

*Primary Examiner*—Edwin A. Leon
(74) *Attorney, Agent, or Firm*—Martin J. Moran

(57) ABSTRACT

A latch engagement control mechanism is provided for a latch assembly of a circuit breaker including a housing, separable contacts, and an operating mechanism having a pole shaft, and at least one link coupled to the pole shaft. The latch assembly includes a pivot member cooperable with such link. The latch engagement control mechanism includes a latch pin having a cut-out portion and pivoting among a first position in which the latch pin prevents the pivot member from pivoting, and a second position in which the cut-out portion provides a clearance for the pivot member to pivot. A latch member coupled to the latch pin at or about the cut-out portion, includes at least a first protrusion engageable by the pivot member to establish the first position of the latch pin.

22 Claims, 6 Drawing Sheets

ELECTRICAL SWITCHING APPARATUS, AND LATCH ASSEMBLY AND LATCH ENGAGEMENT CONTROL MECHANISM THEREFOR

BACKGROUND OF THE INVENTION

1. Field of the Invention

The invention relates generally to electrical switching apparatus and, more particularly, to latch assemblies for electrical switching apparatus, such as circuit breakers. The invention also relates to latch engagement control mechanisms for circuit breaker latch assemblies.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include a housing, and an operating mechanism which opens separable electrical contacts to interrupt the flow of current through the conductors of an electrical system in response to such fault conditions as detected, for example, by a trip unit. The operating mechanism can also be employed to manually open and close the separable contacts, for example, by manipulating an actuator such as, for example and without limitation, a push button disposed on the exterior of the circuit breaker housing.

The operating mechanisms of some low-voltage circuit breakers, for example, typically include both a closing assembly and an opening assembly that are structured to close (e.g., contacts electrically connected) and open (e.g., contacts separated), respectively, the separable contacts. Specifically, the operating mechanism includes a pole shaft, a number of stored energy devices such as, for example, an opening spring and a closing spring, and a number of links coupled to the pole shaft. Typically, there are at least two links which act cooperatively as a toggle assembly. When the separable contacts are tripped open, the toggle assembly is disposed in a collapsed configuration and, when the separable contacts are closed, the toggle assembly is disposed in a second, straightened position in which the toggle links are generally aligned. The opening spring biases the pole shaft toward the open position, which tends to collapse the toggle assembly. A latch assembly, which is also spring-biased, maintains the toggle assembly in the second position. The toggle assembly, in turn, holds the pole shaft in the closed position. More specifically, the latch assembly is coupled to the toggle assembly either directly or via a number of additional links. When an electrical fault condition occurs, the latch assembly is released, allowing the pole shaft, which is driven by the opening spring to cause the toggle assembly to collapse. Thus, if the toggle assembly is collapsed, the pole shaft can rotate, thereby moving the separable electrical contacts into the open position. Alternatively, the opening operation can be initiated manually, for example, by pushing the aforementioned push button on the circuit breaker housing. Specifically, depressing the push button manipulates the latch assembly which, in turn, releases the toggle assembly causing it to collapse and permit the pole shaft to pivot to open the separable contacts. The latch assembly is operable in a similar manner with respect to the closing assembly.

The latch assembly typically includes a pin member having a flat portion, and a planar pivotal member, sometimes referred to as the "latch plate." The latch plate is structured to engage the pin member unless and until the pin member is sufficiently pivoted for the flat portion to provide a clearance between the latch plate and the pin member. When such clearance is provided, the latch plate may pivot (e.g., swing), thereby releasing the toggle assembly to collapse. The distance from the contact point where the latch plate makes contact with the pin member to the flat portion of the pin member, is referred to as the "latch engagement." The latch engagement and, in particular, maintaining a consistent latch engagement, is critical to performance of the circuit breaker. For example, if the latch engagement is too large, the pin member requires too much work to pivot enough to allow clearance for the latch plate to swing and, if the latch engagement is too small, premature, unintentional release of the latch assembly could result. More specifically, if the latch engagement is too small, minor variations or vibrations or other disturbances could undesirably cause such unintentional release. Also, if the latch engagement is small, the forces and associated stress on the relatively small piece of material that is maintaining the engagement, are significant, and could cause the piece to fail (e.g., become deformed; break).

Among the disadvantages with known latch assemblies is that the latch engagement is sometimes inconsistent. This is, in large part, attributable to dimensional tolerance variations among the components of the latch assembly. Specifically, each component has its own set of dimensional tolerances. When the components are assembled, variations in the tolerances can accumulate or "stack" up across the assembly, and thereby adversely affect the latch engagement. Additionally, known latch assemblies typically employ a number of pins, protrusions, or other suitable features to establish and maintain the desired position of the latch pin with respect to the latch plate, and thereby establish the latch engagement. Such features (e.g., pins; protrusions), are typically disposed on a component or portion of the circuit breaker that is separate from the latch pin and/or unrelated to the interaction of the latch pin with the latch plate. Consequently, the latch engagement is compromised because misalignment can occur, for example, from assembly or manufacturing errors, or by the aforementioned stacking of dimensional tolerances across the components of the assembly. As a result, circuit breaker performance suffers.

There is, therefore, room for improvement in electrical switching apparatus, such as circuit breakers, and in latch assemblies and in latch engagement control mechanisms therefor.

SUMMARY OF THE INVENTION

These needs and others are met by embodiments of the invention, which are directed to a latch engagement control mechanism for the latch assemblies of electrical switching apparatus, such as circuit breakers, wherein the components of the latch assembly act cooperatively to effectively provide a consistent latch engagement.

As one aspect of the invention, a latch engagement control mechanism is provided for a latch assembly of an electrical switching apparatus including a housing, separable contacts enclosed by the housing, and an operating mechanism structured to open and close the separable contacts. The operating mechanism includes a pole shaft and at least one link coupled to the pole shaft. The latch assembly includes a pivot member being cooperable with such link. The latch engagement control mechanism comprises: a latch pin including a cut-out portion, the latch pin being pivotable among a first position corresponding to the latch pin being structured to prevent the pivot member from pivoting, and a second position corresponding to the cut-out portion being structured to provide a clearance for the pivot member to pivot; and a latch member coupled to the latch pin at or about the cut-out portion, the latch member comprising a plurality of protrusions. A first one of the protrusions is structured to engage the pivot member, in order to establish the first position of the latch pin with respect to the pivot member. When the latch pin is disposed in the second position, the pivot member pivots, thereby releasing the at least one link to pivot the pole shaft and open the separable contacts.

The operating mechanism may further include an actuator, and a second one of the protrusions is structured to be engageable by the actuator, in order to pivot the latch pin toward the second position. The latch member may further comprise a body, a latch engagement paddle extending outwardly from the body, and a longitudinal hole extending through the body. At least a portion of the cut-out portion of the latch pin may be disposed within the longitudinal hole. The body of the latch member may include an aperture extending through the body, wherein the latch pin and the cut-out portion of the latch pin are structured to be engageable through the aperture by the pivot member. The latch member may be a single-piece molded member, wherein the aperture and the number of protrusions are different sections of the single-piece molded member. The number of edges of the pivot member may be a first edge and a second edge wherein, when the latch pin is disposed in the first position, the latch pin is structured to be engaged by the first edge, and the latch engagement paddle is structured to engage the second edge. When the latch pin is disposed in the second position, the cut-out portion of the latch pin may be structured to disengage the first edge, and the latch engagement paddle may be structured to disengage the second edge.

The latch member may further comprise a spring. The protrusions of the latch member may be a first protrusion extending perpendicularly outwardly from the body, a second protrusion extending perpendicularly outwardly from the body, and a third protrusion extending parallel with respect to the body. The first protrusion may be structured to engage the pivot member. The second protrusion may be structured to be engageable by the actuator in order to pivot the latch pin, and the first end of the spring may be coupled to the third protrusion.

As another aspect of the invention, a latch assembly is provided for an electrical switching apparatus including a housing, separable contacts enclosed by the housing, and an operating mechanism structured to open and close the separable contacts. The operating mechanism includes a pole shaft and at least one link coupled to the pole shaft. The latch assembly comprises: a pivot member structured to be pivotably coupled to the housing and cooperable with the at least one link; and a latch engagement control mechanism comprising: a latch pin including a cut-out portion, the latch pin being pivotable among a first position corresponding to the latch pin preventing the pivot member from pivoting, and a second position corresponding to the cut-out portion providing a clearance for the pivot member to pivot, and a latch member coupled to the latch pin at or about the cut-out portion, the latch member comprising a plurality of protrusions. A first one of the protrusions engages the pivot member, thereby establishing the first position of the latch pin with respect to the pivot member. When the latch pin is disposed in the second position, the pivot member pivots, thereby releasing the at least one link to pivot the pole shaft and open the separable contacts.

As another aspect of the invention, an electrical switching apparatus comprises: a housing; separable contacts enclosed by the housing; an operating mechanism structured to open and close the separable contacts, the operating mechanism including a pole shaft and at least one link coupled to the pole shaft; and a latch assembly comprising: a pivot member pivotably coupled to the housing and cooperable with the at least one link, and a latch engagement control mechanism comprising: a latch pin including a cut-out portion, the latch pin being pivotable among a first position corresponding to the latch pin preventing the pivot member from pivoting, and a second position corresponding to the cut-out portion providing a clearance for the pivot member to pivot, and a latch member coupled to the latch pin at or about the cut-out portion, the latch member comprising a plurality of protrusions. A first one of the protrusions engages the pivot member, thereby establishing the first position of the latch pin with respect to the pivot member. When the latch pin is disposed in the second position, the pivot member pivots, thereby releasing the at least one link to pivot the pole shaft and open the separable contacts.

The pivot member may be a latch plate. The at least one link may comprise a toggle assembly pivotably coupled to the pole shaft, a cradle pivotably coupled to the toggle assembly, and a connecting link interconnecting the cradle and the latch plate. The electrical switching apparatus may be a circuit breaker, and the operating mechanism may include an actuator. The actuator may be movable between an unactuated position corresponding to the separable contacts being closed, and an actuated position corresponding to the separable contacts being open. When the actuator is moved from the unactuated position toward the actuated position, the second end of the actuator may engage and move the second one of the protrusions of the latch member, thereby pivoting the latch pin to release the pivot member. The latch engagement control mechanism may be employed with latch assemblies for both opening and closing the separable contacts.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
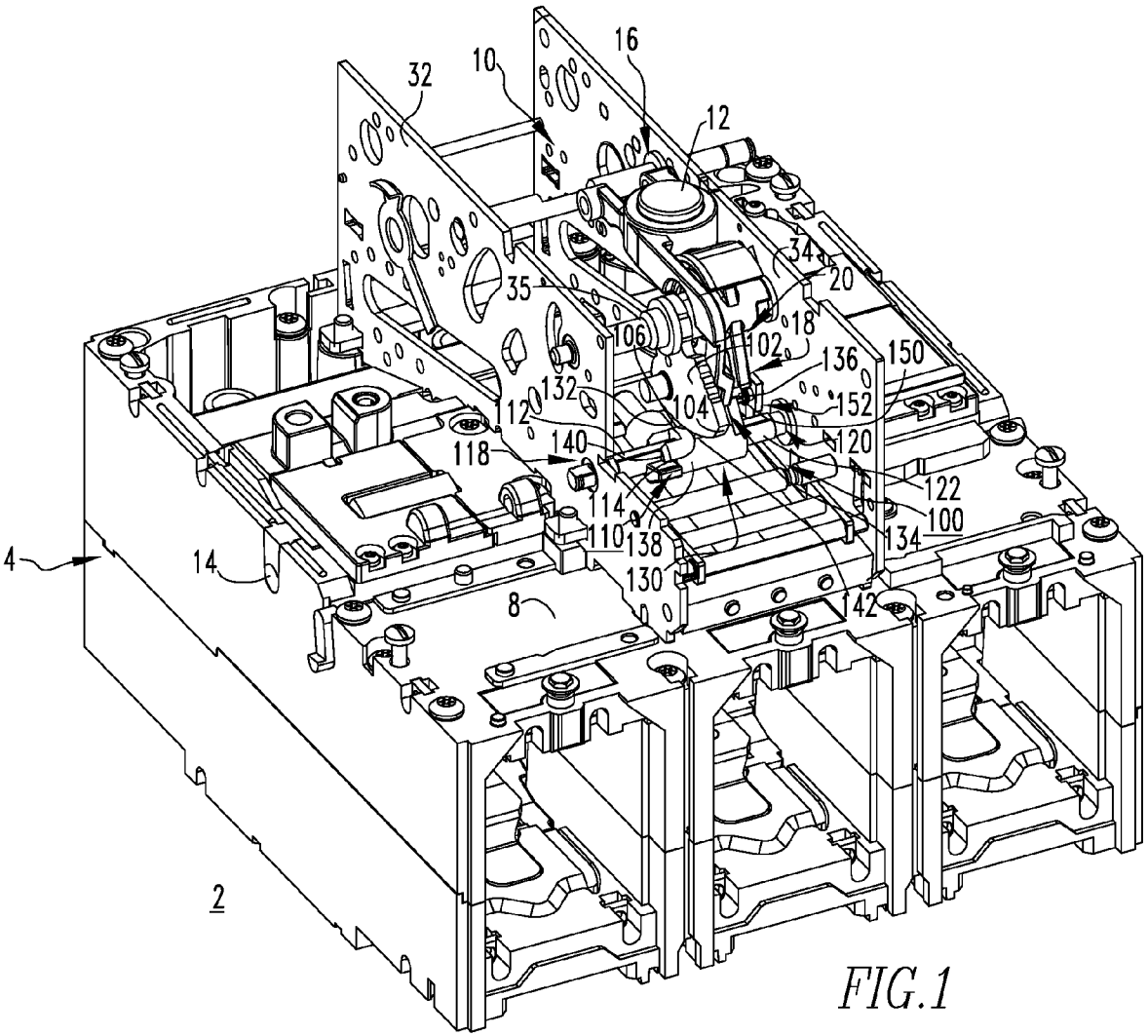
FIG. 1 is an isometric view of a circuit breaker, and a latch assembly and latch engagement control mechanism therefor, in accordance with an embodiment of the invention, also showing the toggle assembly of the circuit breaker.

For purposes of illustration, embodiments of the invention will be described as applied to low-voltage circuit breakers, although it will become apparent that they could also be applied to a wide variety of electrical switching apparatus (e.g., without limitation, circuit switching devices and other circuit interrupters, such as contactors, motor starters, motor controllers and other load controllers) other than low-voltage circuit breakers and other than low-voltage electrical switching apparatus.

Directional phrases used herein, such as, for example, top, bottom, upper, lower, front, back, clockwise, counterclockwise and derivatives thereof, relate to the orientation of the elements shown in the drawings and are not limiting upon the claims unless expressly recited therein.

As employed herein, the terms "actuator" and "actuating mechanism" refer to any known or suitable input mechanism for an electrical switching apparatus (e.g., without limitation, circuit switching devices and other circuit interrupters, such as contactors, motor starters, motor controllers and other load controllers) and expressly include, but are not limited to, levers, buttons (e.g., without limitation, push buttons), and solenoids.

As employed herein, the term "fastener" shall mean a separate element or elements which is/are employed to connect or tighten two or more components together, and expressly includes, without limitation, rivets, pins, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows an electrical switching apparatus such as, for example, a low-voltage circuit breaker 2, including a latch assembly 100 and latch engagement control mechanism 110 therefor. The circuit breaker 2 includes a housing 4, separable contacts 6 (shown in simplified form in FIG. 3A) enclosed by the housing 4, and an operating mechanism 10 (shown in simplified form in FIG. 3A) structured to open and close the separable contacts 6 (FIG. 3A). The operating mechanism 10 includes an actuator, which in the example shown and described herein is a push button 12, a pole shaft 14 (see also pole shaft 14 shown in simplified form in FIGS. 3A and 3B), and at least one link 20 coupled to the pole shaft 14 (best shown in FIG. 2). It will, however, be appreciated that any known or suitable alternative actuator or actuator mechanism (not shown), as defined herein, could be employed without departing from the scope of the invention. It will also be appreciated that although the latch engagement control mechanism 110 is described herein with respect to an opening assembly, for purposes of illustration, that it could be employed with any known or suitable latch assembly such as, for example and without limitation, a latch assembly for a closing assembly (not expressly shown).

Figure 2:
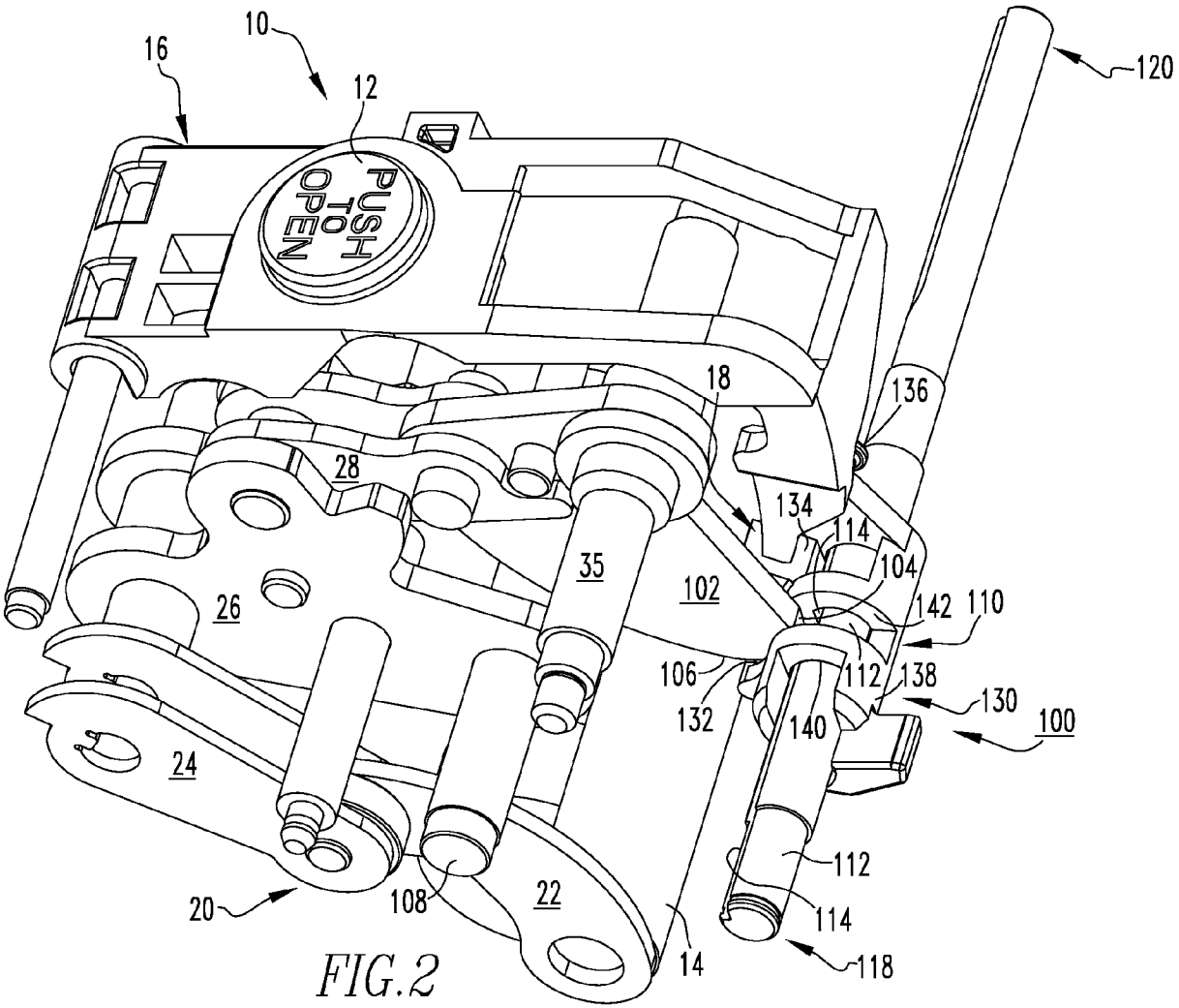
FIG. 2 is an isometric view of the latch assembly and latch engagement control mechanism and toggle assembly of FIG. 1.
Figure 3A:
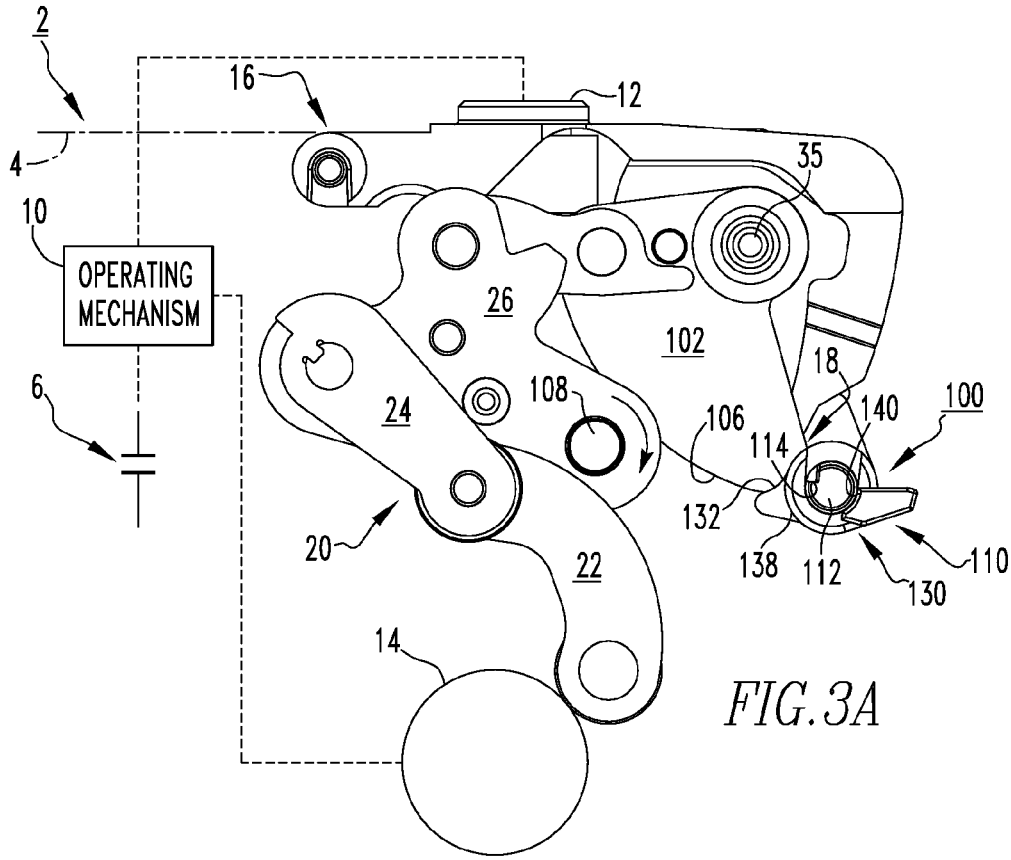
FIGS. 3A and 3B are side elevation views of the latch assembly, and latch engagement control mechanism and toggle assembly of FIG. 2, with the toggle in the latched and unlatched positions, respectively.
Figure 3B:
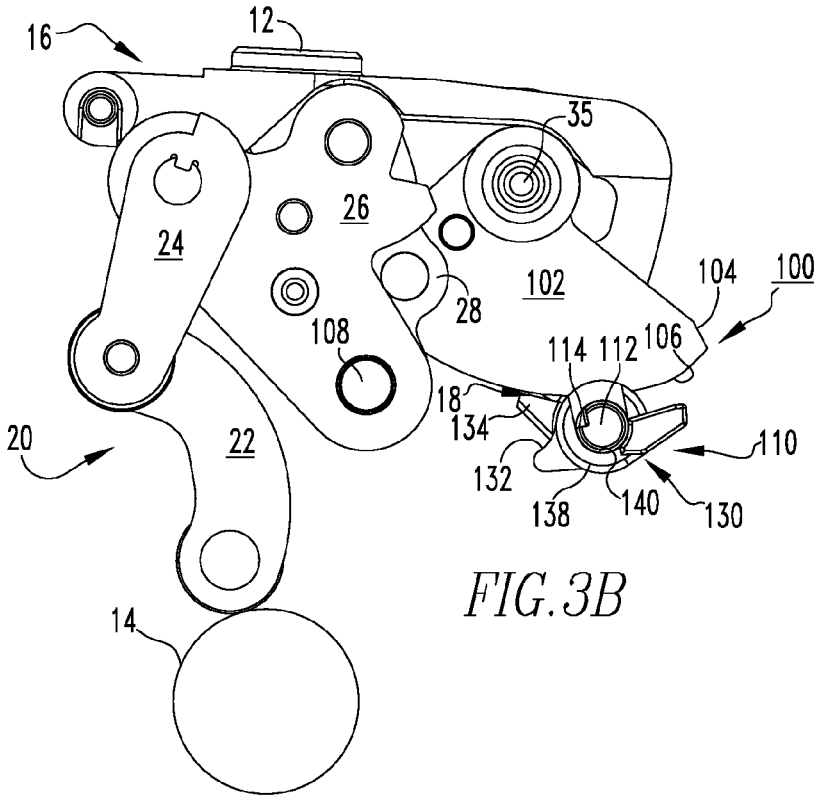
Figure 4A:
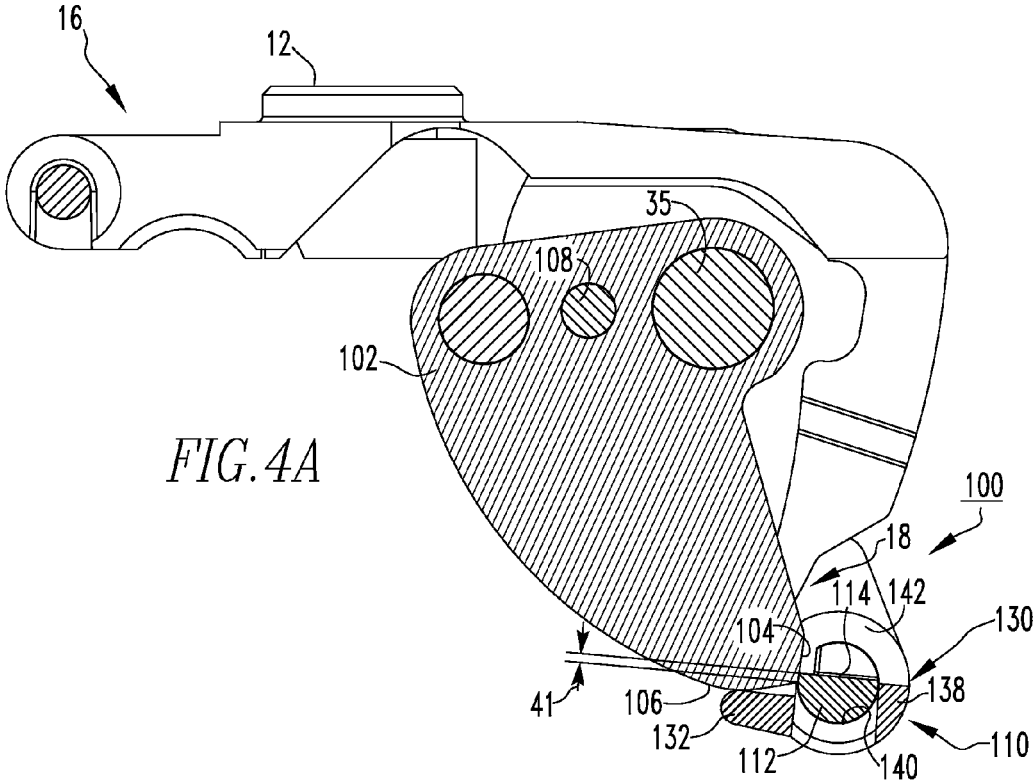
FIGS. 4A and 4B are partially sectioned, side elevation views of a portion of the latch assembly and latch engagement control mechanism of FIGS. 3A and 3B, respectively.

As shown in FIG. 1 and also FIGS. 2, 3A, 3B, 4A and 4B, the latch assembly 100 includes a pivot member 102, commonly referred to as the latch plate, which is structured to be pivotably coupled to the housing 4 (see latch plate 102 pivotably coupled between the first and second side plates 32,34 of housing 4 by pin member 35 in FIG. 1) and is cooperable with the aforementioned link(s) 20 (FIGS. 1, 2, 3A and 3B). The latch assembly 100 further includes the aforementioned latch engagement control mechanism 110. The latch engagement control mechanism 110 includes a latch pin 112 (shown by itself in FIG. 6) having a cut-out portion 114, and being pivotable among a first position (FIGS. 2, 3A and 4A) corresponding to the latch pin 112 preventing the latch plate 102 from pivoting, and the second position (FIGS. 1, 3B and 4B) corresponding to the cut-out portion 114 of the latch pin 112 providing a clearance 116 (FIG. 4B) for the latch plate 102 to pivot (e.g., counterclockwise with respect to FIGS. 3B and 4B) about pin member 35, in the direction generally indicated by arrow 37 in FIG. 4B. A latch member 130 (see also FIG. 5) is coupled to the latch pin 112 at or about the cut-out portion 114 thereof, and includes a plurality of protrusions 132,134, 136 (all shown in FIG. 5). A first one of the protrusions, 132, engages the latch plate 102, thereby establishing the first position of the latch pin 112 with respect to the latch plate member 102, as shown in FIGS. 2, 3A and 4A. In this manner, the disclosed latch engagement control mechanism 110 and, in particular, the latch member 130 and latch pin 112 thereof, cooperate together as one unit, and further cooperate directly with the latch plate 102, rather than through one or more intermediate parts, as is known to be disadvantageous.

Figure 4B:
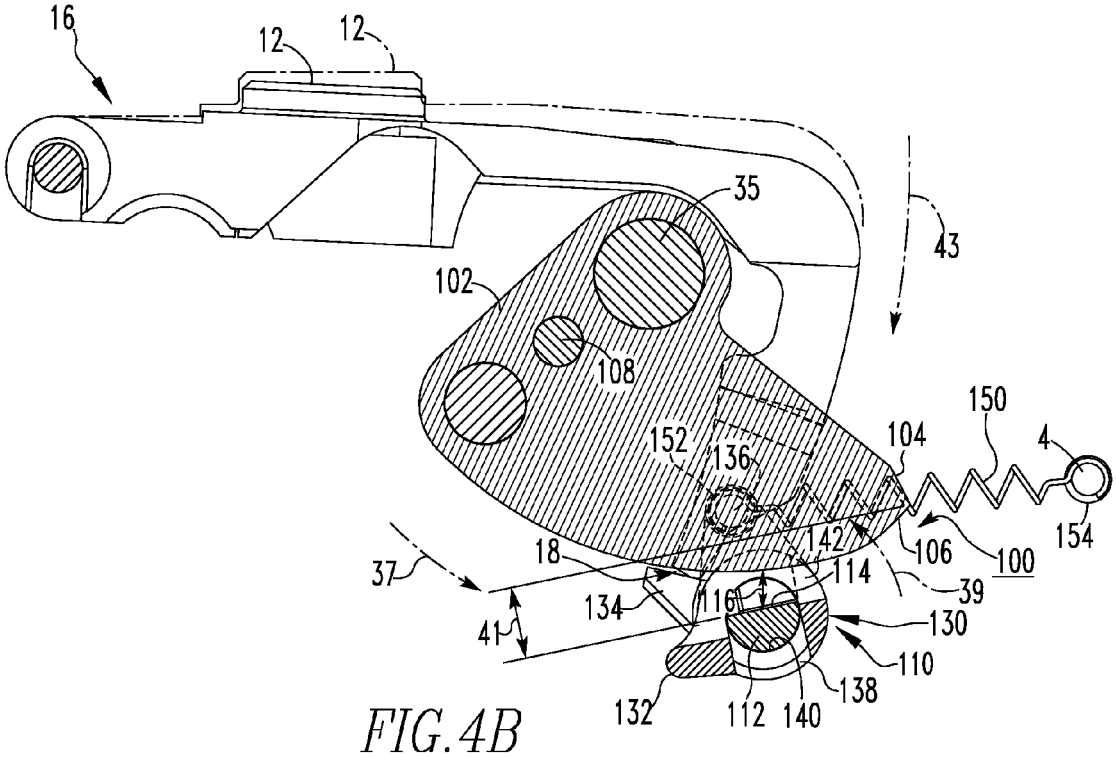

In the example latch engagement control mechanism 110 shown and described herein, a second one of the protrusions, 134, is structured to be engageable by the second end 18 of the push button 12, when the push button 12 is depressed to the position shown in FIG. 4B. Depressing the push button 12 thus pivots the latch pin 112 (e.g., counterclockwise with respect to FIG. 4B) in the direction generally indicated by arrow 39 of FIG. 4B, toward the second position, shown. When the latch pin 112 is disposed in the second position, the latch plate 102 pivots (e.g., counterclockwise with respect to FIGS. 3B and 4B) about pin member 35, as previously discussed. In this manner, as will be discussed in greater detail hereinbelow, the latch plate 102 releases the links (e.g., without limitation, toggle assembly 20; cradle 26; connecting link 28) (FIGS. 2, 3A and 3B) allowing the pole shaft 14 (shown in simplified form in FIGS. 3A and 3B) to pivot and open the separable contacts 6 (shown in simplified form in FIG. 3A). It will, however, be appreciated that the second protrusion 134 is not required. The latch member 130 could have any known or suitable alternative number and configuration of protrusions, and/or such protrusions could be disposed remote from the latch member 130, without departing from the scope of the invention.

The example latch plate 102 has first and second edges 104,106. When the latch pin 112 of the latch assembly 100 is disposed in the first position of FIGS. 2, 3A and 4A, the first edge 104 of the latch plate 102 engages the latch pin 112, as best shown in FIG. 4A. When the latch pin 112 moves toward the second position of FIGS. 1, 3B and 4B, the cut-out portion 114 (best shown in FIG. 6) of the latch pin 112 pivots (e.g., counterclockwise with respect to FIGS. 3B and 4B) in the direction generally indicated by arrow 39 in FIG. 4B), out of the way of the first edge 104, in order to provide the aforementioned clearance 116 (FIG. 4B) for the latch plate 102 to swing (e.g., counterclockwise with respect to FIGS. 3B and 4B) about pin member 35. Accordingly, it will be appreciated that the disclosed latch engagement control mechanism 110 cooperates directly with the latch plate 102 in at least two important regards. First, the latch plate 102 and, in particular, the first edge 104 of the latch plate 102, is cooperable directly with the latch pin 112 and cut-out portion 114 thereof. Second, the first protrusion, which in the example shown and described herein is a latch engagement paddle 132, cooperates directly with the second edge 106 of the latch plate 102, in order to engage the second edge 106 and establish the desired relationship between the cut-out portion 114 of the latch pin 112 and the first edge 104 of the latch plate 102. That relationship, which is best shown in FIGS. 4A and 4B, is the latch engagement 41. Thus, contrary to known latch assembly designs wherein a number of unrelated features (e.g., without limitation, pins; protrusions; paddles; cut-outs), which are disposed in a distal location and/or are coupled to a separate, unrelated structure (e.g., without limitation, the side plates of the circuit breaker housing) of the circuit breaker, are employed to establish the latch engagement, the disclosed latch engagement control mechanism 110 cooperates directly with the latch plate 102. In this manner, the disclosed latch assembly 100 and latch engagement control mechanism 110 therefor overcome the disadvantages (e.g., without limitation, misalignment; inconsistent latch engagement) of such designs.

Figure 5:
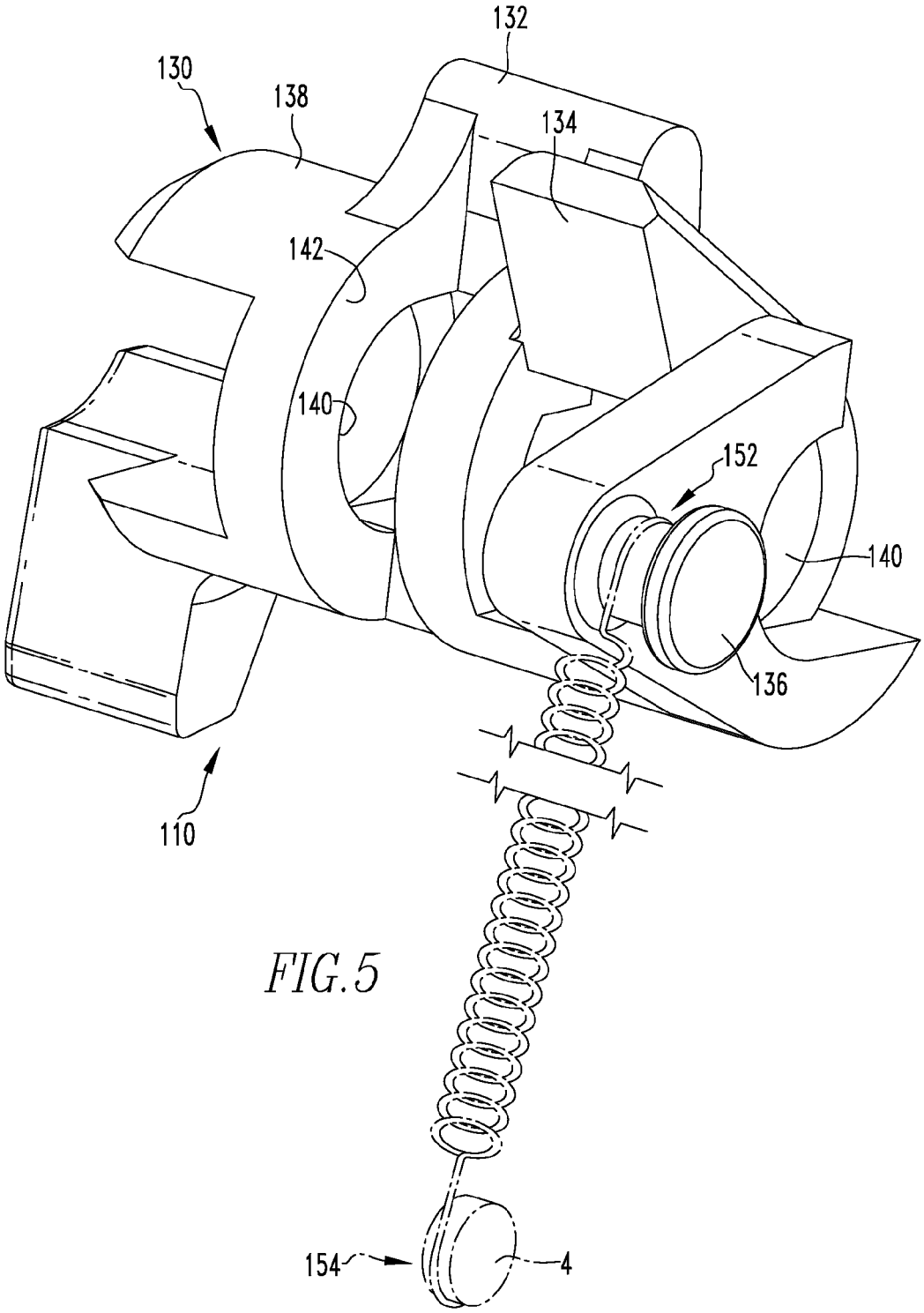
FIG. 5 is an isometric view of the latch engagement control mechanism of FIG. 2.
Figure 6:
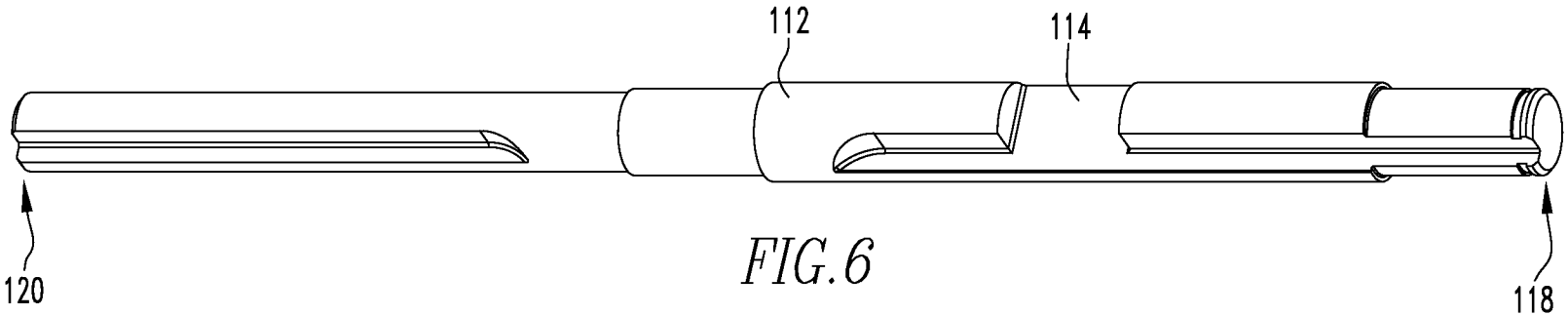
FIG. 6 is an isometric view of the latch pin of the latch engagement control mechanism of FIG. 2.

More specifically, the latch member 130 of the example latch engagement control mechanism 110 further includes a body 138, the aforementioned latch engagement paddle 132, which extends outwardly from the body 138, and a longitudinal hole 140 extending through the body 138. At least a portion of the cut-out portion 114 of the latch pin 112 is disposed within the longitudinal hole 140, as best shown in FIGS. 2 and 4A. In particular, as shown in FIG. 6, the example cut-out portion 114 is a flat portion that extends through the latch pin 112 to form a "notch" that is disposed only at the portion of the latch pin 112 that is cooperable directly with the latch plate 102. It will, however, be appreciated that any known or suitable cut-out portion (not shown) other than the example flat notch 114 could be employed, without departing from the scope of the invention. The body 138 of the example latch member 130 also includes an aperture 142 extending through the body 138 (best shown in FIGS. 2, 4A, 4B and 5), in order to provide direct access for the latch plate 102 to cooperate with the latch pin 112 and flat notch 114 thereof. Accordingly, the latch plate first and second edges 104 and 106 are engaged and disengaged, respectively, by the latch pin 112 and latch engagement paddle 132, when the latch pin 112 is disposed in the first (FIGS. 2, 3A and 4A) and second (FIGS. 1, 3B and 4B) positions. The latch member 130 (best shown in FIGS. 2 and 5) of the example latch engagement control mechanism 110 is a single-piece molded member, with the protrusions (e.g., latch plate paddle 132; second protrusion 134; third protrusion 136) comprising different sections or segments of the same single-piece molded member 130.

The first protrusion (e.g., latch engagement paddle 132) and second protrusion 134 extend perpendicularly outwardly from the body 138 of the latch member 130. The third protrusion 136 extends generally parallel with respect to the body 138, as best shown in FIG. 5. The first protrusion (e.g., latch engagement paddle 132) has been discussed hereinabove. The optional second protrusion, which in the example shown and described herein is a molded protrusion 134 extending outwardly from the body 138 of the latch member 130, is engageable by the second end 18 of the actuator (e.g., without limitation, push button 12) when the first end 16 of the actuator 12 is engaged and actuated. More specifically, as shown in the example of FIG. 4B, when the push button 12 is depressed, the second end 18 of the push button 12 deflects (e.g., downward from the perspective of FIG. 4B) in the direction generally indicated by arrow 43, in order to engage the second protrusion 134 and pivot the latch member 130 and latch pin 112 in the direction generally indicated by arrow 39. The latch member 130 and latch pin 112 are securely coupled together so as not to move independently with respect to one another. The third protrusion 136 (partially shown in FIG. 2; shown in hidden line drawing in FIG. 4B; best shown in FIG. 5), is structured to receive the first end 152 (partially shown in FIG. 1; shown in hidden line drawing in FIG. 4B; shown in phantom line drawing in FIG. 5) of a bias element (FIGS. 1, 4B and 5), which in the example shown and described herein is a spring 150. As shown in simplified form in FIG. 4B and in simplified form in phantom line drawing in FIG. 5, the second end 154 of the example spring 150 is coupled to the circuit breaker housing 4. It will, therefore, be appreciated that the spring 150 is structured to bias the latch pin 112 toward the first position, shown in FIGS. 2, 3A and 4A. More specifically, the spring 150 biases the latch engagement paddle 132 into engagement with the second edge 106 of the example latch plate 102, as shown in FIGS. 3A and 4A, in order to establish the latch engagement 41 (FIGS. 4A and 4B) in a consistent and repeatable manner.

Accordingly, the latch engagement control mechanism 110 of the disclosed latch assembly 100 provides a mechanism for precisely and consistently establishing and maintaining the latch engagement 41 (FIGS. 4A and 4B) of the latch assembly 100, and thereby provides consistent, effective operation of the latch assembly 100 to open the separable contacts 6 (shown in simplified form in FIG. 3A).

Referring again to FIGS. 3A and 3B, the example latch plate 102 is structured to cooperate with a connecting link 28. The example connecting link 28 is pivotably coupled to the latch plate 102 and to the cradle 26. The cradle 26 is, in turn, pivotably coupled to the toggle assembly 20, which in the example shown and described herein includes first and second links 22,24. More specifically, the second link 24 is pivotably coupled to the cradle 26 at one end and, at the other end, is pivotably coupled to the first link 22. The first link 22 is, in turn, pivotably coupled to the pole shaft 14, as shown in simplified form in FIGS. 3A and 3B (see also second link 22 of toggle assembly 20 pivotably coupled to pole shaft 14 in FIG. 2). Thus, it will be appreciated that the toggle assembly 20 is movable among the straightened, nearly aligned position of FIG. 3A, corresponding to the separable contacts 6 being closed, and a collapsed position (FIG. 3B) corresponding to the separable contacts 6 (FIG. 3A) being open. Accordingly, in operation, when the latch pin 112 is disposed in the first position of FIG. 3A, the links 22,24 of the toggle assembly 20 are generally straight. Then, when the push button 12 is depressed, as shown in phantom line drawing in FIG. 4B, to open the separable contacts 6 (FIG. 3A) and the latch pin 112 is pivoted toward the second position of FIG. 3B, the latch plate 102 pivots (e.g., swings), moving the connecting link 28 and allowing the cradle 26 to pivot about pin 108 which, in turn, allows the toggle assembly 20 to collapse (FIG. 3B).

It will be appreciated that any known or suitable alternative number and/or configuration of links (not shown) other than that which is shown and described herein, could be employed in order to transfer motion from the disclosed latch assembly 100 to the pole shaft 14, as desired. It will further be appreciated that although the example latch pin 112 is an elongated member having first and second ends 118,120 pivotably coupled to first and second side plates 32,34, respectively, which extend outwardly from a mounting surface 8 of the circuit breaker housing 4 (FIG. 1), that the latch pin 112, as well as the other components (e.g., without limitation, latch plate 102; latch member 130) of the latch assembly 100 could have any suitable alternative configuration (not shown) with respect to the circuit breaker housing 4. For example and without limitation, although the example latch engagement control mechanism 110 is contemplated as comprising a two-component assembly (e.g., latch member 130 and latch pin 112), wherein the latch member 130 is precisely press-fit onto the latch pin 112 in a predetermined orientation and location, the latch member 130 could alternatively be suitably secured to the latch pin 112 in any suitable manner other than by press-fit. Additionally, the latch engagement control mechanism 110 could alternatively comprise a single-piece of material wherein the latch pin 112 and features (e.g., without limitation, first, second and third protrusions 132,134,136) of the latch member 130 are machined as part of the single-piece of material. It will also be appreciated that the disclosed latch engagement control mechanism 110 can be employed with any known or suitable type (e.g., without limitation, opening; closing) and configuration of latch assembly (e.g., 100).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A latch engagement control mechanism for a latch assembly of an electrical switching apparatus including a housing, separable contacts enclosed by said housing, and an operating mechanism for opening and closing said separable contacts, said operating mechanism including a pole shaft and at least one link coupled to said pole shaft, said latch assembly including a pivot member being cooperable with said at least one link, said latch engagement control mechanism comprising:

a latch pin including a cut-out portion, said latch pin being pivotable among a first position corresponding to said latch pin preventing said pivot member from pivoting, and a second position corresponding to said cut-out portion providing a clearance for said pivot member to pivot; and a latch member coupled to said latch pin at or about said cut-out portion, said latch member comprising a plurality of protrusions, wherein a first one of said protrusions engages said pivot member, in order to establish said first position of said latch pin with respect to said pivot member, and wherein, when said latch pin is disposed in said second position, said pivot member pivots, thereby releasing said at least one link to pivot said pole shaft and open said separable contacts.

2. The latch engagement control mechanism of claim 1 wherein said pivot member includes a number of edges; wherein, when said latch pin is disposed in said first position, said latch pin is engaged by a corresponding one of said edges; and wherein, when said latch pin moves toward said second position, said cut-out portion of said latch pin pivots out of the way of said corresponding one of said edges.

3. The latch engagement control mechanism of claim 2 wherein said latch member further comprises a body, a latch engagement paddle extending outwardly from said body, and a longitudinal hole extending through said body; and wherein at least a portion of said cut-out portion of said latch pin is disposed within said longitudinal hole.

4. The latch engagement control mechanism of claim 3 wherein said body of said latch member includes an aperture extending through said body; and wherein said latch pin and said cut-out portion of said latch pin are engageable through said aperture by said pivot member.

5. The latch engagement control mechanism of claim 3 wherein said number of edges of said pivot member is a first edge and a second edge; wherein, when said latch pin is disposed in said first position, said latch pin is engaged by said first edge, and said latch engagement paddle engages said second edge; and wherein, when said latch pin is disposed in said second position, said cut-out portion of said latch pin disengages said first edge, and said latch engagement paddle disengages said second edge.

6. The latch engagement control mechanism of claim 3 wherein said latch member is a single-piece molded member; and wherein said aperture and said number of protrusions are different sections of said single-piece molded member.

7. The latch engagement control mechanism of claim 1 wherein said latch member further comprises a bias element biasing said latch pin toward said first position, and further to bias said first one of said protrusions toward engagement with said pivot member; and wherein said bias element includes a first end coupled to said latch member, and a second end structured to be coupled to said housing.

8. The latch engagement control mechanism of claim 7 wherein said operating mechanism further includes an actuator; wherein said latch member includes a body; wherein said bias element is a spring; wherein said protrusions of said latch member are a first protrusion extending perpendicularly outwardly from said body, a second protrusion extending perpendicularly outwardly from said body, and a third protrusion extending parallel with respect to said body; wherein said first protrusion engages said pivot member; wherein said second protrusion is engageable by said actuator in order to pivot said latch pin toward said second position; and wherein the first end of said spring is coupled to said third protrusion.

9. A latch assembly for an electrical switching apparatus including a housing, separable contacts enclosed by said housing, and an operating mechanism structured to open and close said separable contacts, said operating mechanism including a pole shaft and at least one link coupled to said pole shaft, said latch assembly comprising:

a pivot member structured to be pivotably coupled to said housing and cooperable with said at least one link; and a latch engagement control mechanism comprising:

a latch pin including a cut-out portion, said latch pin being pivotable among a first position corresponding to said latch pin preventing said pivot member from pivoting, and a second position corresponding to said cut-out portion providing a clearance for said pivot member to pivot, and a latch member coupled to said latch pin at or about said cut-out portion, said latch member comprising a plurality of protrusions, wherein a first one of said protrusions engages said pivot member, thereby establishing said first position of said latch pin with respect to said pivot member, and wherein, when said latch pin is disposed in said second position, said pivot member pivots, thereby releasing said at least one link to pivot said pole shaft and open said separable contacts.

10. The latch assembly of claim 9 wherein said pivot member is a substantially planar member having a first edge and a second edge; wherein, when said latch pin is disposed in said first position, said first edge engages said latch pin and said first one of said protrusions engages said second edge; and wherein, when said latch pin is disposed in said second position, said cut-out portion of said latch pin disengages said first edge, and said first one of said protrusions disengages said second edge.

11. The latch assembly of claim 10 wherein said latch member further comprises a body, a latch engagement paddle extending outwardly from said body, and a longitudinal hole extending through said body; wherein at least a portion of said cut-out portion of said latch pin is disposed within said longitudinal hole; and wherein said body of said latch member includes an aperture extending through said body, in order to provide access for said first edge of said pivot member to cooperate directly with said latch pin and said cut-out portion thereof.

12. The latch assembly of claim 9 wherein said latch member further comprises a bias element biasing said latch pin toward said first position, and further biasing said first one of said protrusions toward engagement with said pivot member; and wherein said bias element includes a first end coupled to said latch member, and a second end structured to be coupled to said housing.

13. The latch assembly of claim 12 wherein said operating mechanism further includes an actuator; wherein said latch member includes a body; wherein said bias element is a spring; wherein said protrusions of said latch member are a first protrusion extending perpendicularly outwardly from said body, a second protrusion extending perpendicularly outwardly from said body, and a third protrusion extending parallel with respect to said body; wherein said first protrusion is engageable by said pivot member; wherein said second protrusion is engageable by said actuator in order to pivot said latch pin toward said second position; and wherein the first end of said spring is coupled to said third protrusion.

14. An electrical switching apparatus comprising:

a housing;

separable contacts enclosed by said housing;

an operating mechanism structured to open and close said separable contacts, said operating mechanism including a pole shaft and at least one link coupled to said pole shaft; and a latch assembly comprising:

a pivot member pivotably coupled to said housing and cooperable with said at least one link, and a latch engagement control mechanism comprising:

a latch pin including a cut-out portion, said latch pin being pivotable among a first position corresponding to said latch pin preventing said pivot member from pivoting, and a second position corresponding to said cut-out portion providing a clearance for said pivot member to pivot, and a latch member coupled to said latch pin at or about said cut-out portion, said latch member comprising a plurality of protrusions, wherein a first one of said protrusions engages said pivot member, thereby establishing said first position of said latch pin with respect to said pivot member, and wherein, when said latch pin is disposed in said second position, said pivot member pivots, thereby releasing said at least one link to pivot said pole shaft and open said separable contacts.

15. The electrical switching apparatus of claim 14 wherein said pivot member of said latch assembly includes a first edge and a second edge; wherein, when said latch pin of said latch engagement control mechanism of said latch assembly is disposed in said first position, said first edge of said pivot member engages said latch pin and said first one of said protrusions of said latch member engages said second edge of said pivot member; and wherein, when said latch pin is disposed in said second position, said cut-out portion of said latch pin disengages said first edge of said pivot member, and said first one of said protrusions disengages said second edge of said pivot member.

16. The electrical switching apparatus of claim 15 wherein said latch member of said latch engagement control mechanism of said latch assembly further comprises a body, a latch engagement paddle extending outwardly from said body, and a longitudinal hole extending through said body; wherein at least a portion of said cut-out portion of said latch pin is disposed within said longitudinal hole; and wherein said body of said latch member includes an aperture extending through said body, in order to provide access for said first edge of said pivot member to cooperate directly with said latch pin and said cut-out portion thereof.

17. The electrical switching apparatus of claim 14 wherein said latch member further comprises a bias element biasing said latch pin toward said first position, and further biasing said first one of said protrusions toward engagement with said pivot member; and wherein said bias element includes a first end coupled to said latch member, and a second end coupled to said housing.

18. The electrical switching apparatus of claim 17 wherein said operating mechanism further includes an actuator; wherein said latch member includes a body; wherein said bias element is a spring; wherein said protrusions of said latch member of said latch engagement control mechanism of said latch assembly are a first protrusion extending perpendicularly outwardly from said body, a second protrusion extending perpendicularly outwardly from said body, and a third protrusion extending parallel with respect to said body; wherein said first protrusion is engageable by said pivot member; wherein said second protrusion is engageable by said actuator in order to pivot said latch pin toward said second position; and wherein the first end of said spring is coupled to said third protrusion.

19. The electrical switching apparatus of claim 14 wherein said pivot member is a latch plate; wherein said at least one link comprises a toggle assembly pivotably coupled to said pole shaft, a cradle pivotably coupled to said toggle assembly, and a connecting link interconnecting said cradle and said latch plate; and wherein, when said actuator is actuated and said latch pin moves toward said second position, said latch plate pivots, thereby moving said connecting link and said cradle to collapse said toggle assembly.

20. The electrical switching apparatus of claim 19 wherein said toggle assembly has a generally straight position corresponding to said separable contacts being closed, and a collapsed position corresponding to said separable contacts being open; wherein, when said latch pin is disposed in said first position, said toggle assembly is disposed in said generally straight position; and wherein, when said latch pin is pivoted toward said second position and said latch plate moves said connecting link, said toggle assembly moves to said collapsed position.

21. The electrical switching apparatus of claim 14 wherein said electrical switching apparatus is a circuit breaker; wherein said actuator has a first end accessible external to said housing, and a second end disposed proximate said latch pin of said latch engagement control mechanism of said latch assembly; wherein said actuator is movable between an unactuated position corresponding to said separable contacts being closed, and an actuated position corresponding to said separable contacts being open; and wherein, when said actuator is moved from said unactuated position toward said actuated position, the second end of said actuator engages and moves said second one of said protrusions of said latch member, thereby pivoting said latch pin to release said pivot member.

22. The electrical switching apparatus of claim 21 wherein said housing includes a mounting surface, a first side plate extending outwardly from said mounting surface, and a second side plate extending outwardly from said mounting surface; wherein said latch assembly is substantially disposed between said first side plate and said second side plate; wherein said latch pin of said latch engagement control mechanism of said latch assembly includes a first end pivotably coupled to said first side plate, a second end pivotably coupled to said second side plate, and an elongated body extending between said first and second ends of said latch pin; and wherein said cut-out portion of said latch pin is a flat portion disposed between the first end of said latch pin toward the second end of said latch pin.

* * * * *